United States Patent [19]

Bailey

[11] Patent Number: 4,643,340

[45] Date of Patent: Feb. 17, 1987

[54] TRANSFER MECHANISM FOR TRANSFERRING HOSIERY ARTICLES

[75] Inventor: Peter Bailey, Loughborough, England

[73] Assignee: Pex (Holdings) Limited, Leicester, England

[21] Appl. No.: 800,047

[22] Filed: Nov. 20, 1985

[30] Foreign Application Priority Data

Nov. 29, 1984 [DE] Fed. Rep. of Germany ..... 3443432

[51] Int. Cl.[4] ..... A41H 42/00; D06G 3/02; D04B 9/56

[52] U.S. Cl. ..... 223/40; 223/75; 223/112

[58] Field of Search ..... 223/39, 40, 41, 42, 223/43, 75, 112

[56] References Cited

U.S. PATENT DOCUMENTS 4,223,816 9/1980 Glover ..... 223/40 X 4,487,546 12/1984 Cassinelli ..... 223/41 X

*Primary Examiner*—Louis K. Rimrodt

*Attorney, Agent, or Firm*—Charles E. Brown; Charles A. Brown

[57] ABSTRACT

A transfer mechanism for transferring hosiery from a toe-closing machine to a hosiery boarding machine is disclosed which enables the labor content of hosiery production to be reduced. The hosiery is mechanically removed from the toe-closing machine and supported upon a transfer form at its welt end. The hosiery is then stretched and driven fully onto the transfer form. Thereafter a hosiery boarding form is inserted into the foot end of the hosiery to draw the hosiery thereonto while simultaneously turning it.

12 Claims, 11 Drawing Figures

TRANSFER MECHANISM FOR TRANSFERRING HOSIERY ARTICLES

Figures 1, 2, 3, 4, 5:
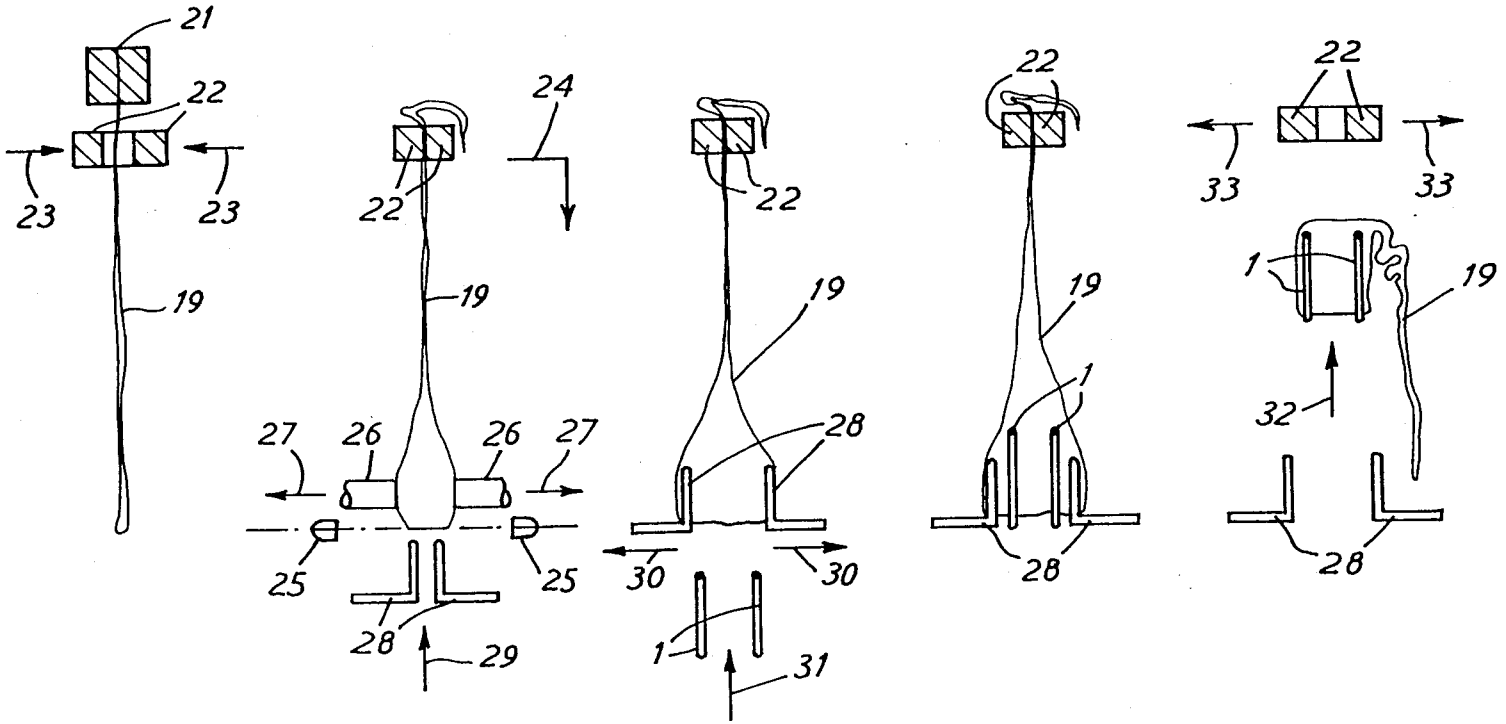

The present invention relates to a transfer mechanism for and method of transferring articles from a first to a second machine and is concerned particularly, but not exclusively, with a transfer mechanism and method for transferring hosiery from a toe-closing machine to a boarding machine.

In the manufacture of hosiery, by which term is meant socks, stockings and the like, hosiery is first knitted upon a machine. Traditionally, the hosiery is then turned inside out and loaded onto a toe-closing machine to enable the toe end to be closed off. The hosiery is removed from the toe-closing machine, turned to normal side out, when it can be wet processed, boarded, examined and packed.

The above process is not only labour intensive but also physically tiring.

An object of the invention is to remove at least one of the manual steps involved in hosiery production.

According to the present invention there is provided a method of transferring hosiery between a first machine and a second machine whilst turning the hosiery which comprises mechanically removing the hosiery from the first machine and supporting the mouth of the hosiery upon a transfer form, extending the hosiery whilst the mouth thereof is supported upon the transfer form, driving all the hosiery onto the transfer form, and inserting a boarding form into the hosiery supported upon the transfer form from a direction commencing at the foot end of the hosiery to draw the hosiery onto the boarding form whilst simultaneously turning it.

Also according to the present invention there is provided a transfer mechanism for transferring hosiery between a first machine and a second machine which comprises means for removing hosiery from the first machine and supporting the mouth of the hosiery upon a transfer form, means extending the hosiery whilst supported upon the transfer form, and means for introducing a boarding form to the foot end of the hosiery to draw the hosiery onto the form whilst simultaneously turning it.

Normally, the first machine is a toe-closing machine where the hosiery is carried on points and the second machine is a hosiery boarding machine. By providing a transfer mechanism for transferring hosiery between toe-closing and boarding machines the labour content between these machines is effectively eliminated.

Furthermore, the invention enables the traditional steps involved in the manufacture of hosiery to be reduced and, if necessary, rearranged. Thus, subsequent to knitting, hosiery blanks may be wet processed and then turned inside out(or vice versa) ready for toe closing. After toe-closing, by virtue of the invention, no labour content is involved and the hosiery is presented on boards, normal side out, to a boarding machine ready for heat setting followed by examination and packing. It will be seen therefore that both the second turning operation of the traditional production method and the loading of the hosiery onto a hosiery form can now be effected mechanically.

Figures 6, 7, 8, 9:
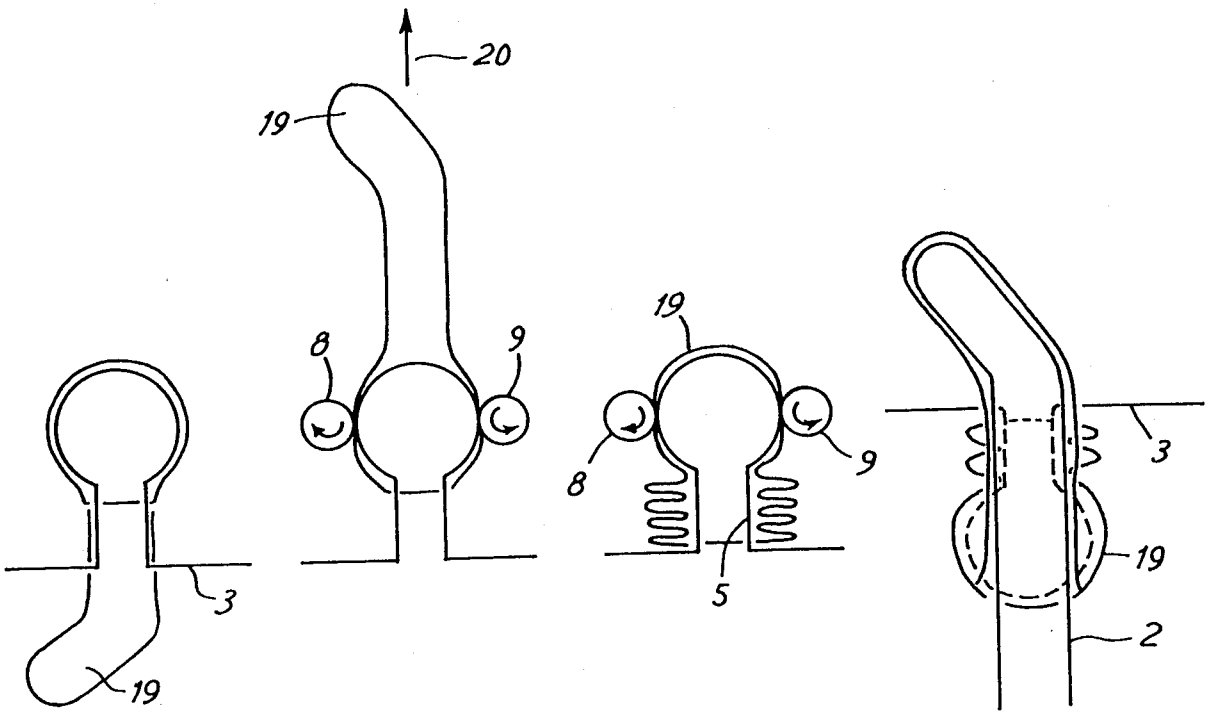
Figure 10:
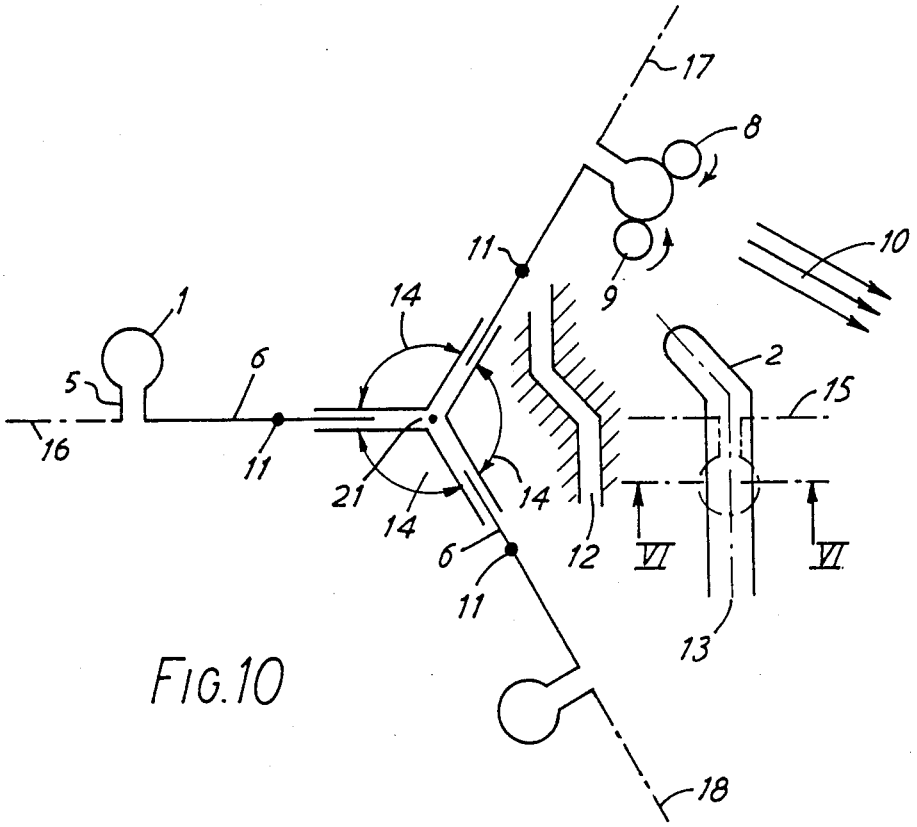
Figure 11:
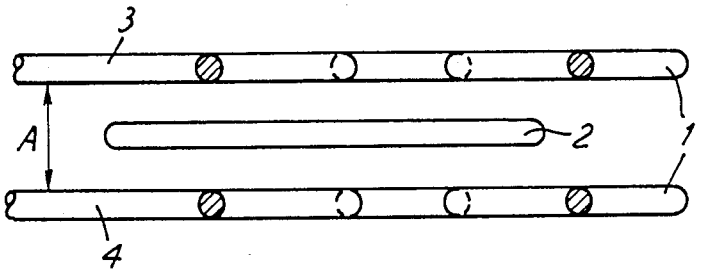

The invention will now be described further by way of example with reference to the accompanying diagrammatic drawings in which:

FIG. 1 illustrates hosiery supported on the points of a toe-closing machine, FIG. 2 illustrates the hosiery removed from the toe-closing machine and held between the jaws of a clamp, FIG. 3 illustrates the mouth of the hosiery being opened by a spreading device, FIG. 4 illustrates the insertion of a two-part transfer form into the opened mouth of the hosiery, FIG. 5 illustrates the hosiery supported on the transfer form having been released by the clamp jaws, FIGS. 6 to 9 are views taken at right angles to those of FIGS. 1 to 5, FIG. 6 depicting the hosiery top supported on the transfer form, corresponding essentially to the position shown in FIG. 5, FIG. 7 illustrates more of the hosiery being driven on to the transfer form by drive rollers, FIG. 8 illustrates the whole of the hosiery supported on the transfer form, FIG. 9 illustrates a boarding form being inserted into the transfer form to remove it therefrom whilst simultaneously turning the hosiery inside out, FIG. 10 illustrates the three limbs of the transfer mechanism and their sequential operation between three stations, and FIG. 11 is a sectional view through the transfer and hosiery forms taken on the line VI—VI of FIG. 10.

In FIG. 1, hosiery in the form of a sock or stocking 19, is supported inside out upon the points (not shown) of a toe-closing machine 21. The toe-closing machine is known per se and forms no part of the invention. The particular toe-closing machine used is known as a Rosso toe-closing machine but other toe-closing machines may be used. The function of the transfer mechanism of the invention is to transfer hosiery automatically from the points of the toe-closing machine onto a hosiery boarding form ready for further processing, typically boarding, examination and packing, ready for sale.

FIG. 1 shows therefore the two jaws 22 of a clamp about to close onto the hosiery 19 at a position below the machine 21. In FIG. 2, the clamp jaws have clamped the hosiery adjacent its toe end and been caused to move in two directions, identified by the arrow 24, both radially away from the machine 21 and then downwardly towards a sensing position. The sensing position consists of a photo-electric cell 25 which is actuated when the mouth or top of the hosiery is detected. Actuation of the cell 25 interrupts downward movement of clamp 22 to leave the hosiery suspended in the position shown in FIG. 2. In this position, the mouth end of the hosiery is disposed adjacent pipes 26. Actuation of the cell 25 also initiates the supply of reduced pressure to the pipes. The action of the reduced pressure is to open the mouth of the hosiery ready to receive the spreader fingers 28 of a spreader.

The spreader has four fingers 28 which lie adjacent one another when the spreader is in a closed condition but which spread radially outwardly when the spreader is opened. FIG. 2 shows the spreader fingers 28 in a closed position and ready for insertion, in the direction of the arrow, into the mouth of the hosiery.

In FIG. 3, the spreader fingers have been inserted into the hosiery and the spreader opened as indicated by the arrows 30. A two-part transfer form 1 is illustrated beneath the spreader and ready for insertion in the direction of arrow 31 between the spreader fingers into the mouth of the hosiery. The two parts of the transfer form are each in the form of a wire bent into the general form of the Greek letter omega as may best be seen from FIG. 6. FIG. 4 shows the transfer form inserted into the mouth of the hosiery. It will be understood that although the transfer form illustrated consists of bent wires, the invention is not limited in this respect since spaced apart members of any suitable configuration may be used.

In FIG. 5 the transfer form has moved upwardly in the direction of arrow 32 to strip the hosiery from the spreader fingers 28. At the same time the jaws 22 of the clamp have opened in the direction 33 to release the housing 19 thus allowing it to hang freely carried solely by the transfer form 1. FIG. 6 corresponds to the position shown in FIG. 5 but shows a view perpendicular to that of FIG. 5 to enable the omega shape of transfer form wires 3 to be seen.

At the position illustrated in FIG. 7 an air current 20 has caused the hosiery 19 to be extended to remove tangles and like irregularities. The hosiery is retained upon the form by virtue of its elastic welt which bears against the bulbous underside of the tranfer form. A pair of rollers 8, 9 are then placed in driving engagement with opposed parts of the housing supported upon the transfer form 30. The rollers 8, 9 drive the leg and toe portions of the hosiery onto the transfer form until the whole length of the hosiery is accommodated upon the form as may be seen in FIG. 8, where the leg length of the hosiery is folded as a concertina upon the neck 5 of the omega-shaped wires 3.

FIG. 9 shows a flat hosiery form 2 being inserted into the spacing between the two transfer form wires 3. During this operation, as the housing is being received onto the housing form, it is simultaneously being turned to correct side out.

At the completion of the cycle of operations described above, the hosiery, supported upon the hosiery form 2 is ready for heat setting in a boarding machine( not shown) followed by inspection and, if satisfactory, for packing. The step of turning of the hosiery correct side out which was previously achieved manually is now achieved automatically. Further, the step of manual loading of the hosiery upon the form is eliminated.

The transfer mechanism is illustrated in its practical form in FIG. 10 in which similar reference numerals have been used to identify the same parts as those referred to in FIGS. 1 to 9. For ease of illustration however, no hosiery is shown in FIG. 10.

The mechanism of FIG. 10 consists of a wheel having three tubular limbs which are equi-angularly spaced apart by an angle 14. The wheel is rotatably mounted at 21 for indexed movement between three stations 16, 17 and 18. A rod 6 is resiliently mounted, by springs not shown, in each tubular limb to enable each rod 6 to move, as a piston, in its associated limb. Intermediate the ends of each rod 6, a roller cam 11 is provided which travels along a guide track 12 between stations 17 and 18 for a purpose to be described. A transfer form 1 is fixed to the outer end of each rod 6 for movement therewith.

Station 16 corresponds with the positions shown in FIGS. 5 and 6 where hosiery is initially received upon, and suspended from the transfer form 1. The wheel is then indexed by one movement in a clockwise direction so that the transfer form previously at station 16 arrives at station 17. Station 17 corresponds with the positions shown in FIGS. 7 and 8 inasmuch as the hosiery is extended by an air stream 10 and then driven onto the two wires of the transfer form 1 by the rollers 8, 9. Subsequent to loading the rollers 8, 9 are moved away from the form to enable the wheel to be further indexed.

As the wheel is indexed once more, the roller cam 11 enters the guide track 12 so that the transfer form is displaced relative to the longitudinal axis 13 of the boarding form 2. During this movement, the boarding form 2 strips the hosiery from the transfer form simultaneously turning the hosiery correct side out. Thus, the step between stations 17 and 18 corresponds with that shown in FIG. 9 so that by the time station 18 is reached, the transfer form is free to receive further hosiery.

In the transfer mechanism as at present, no hosiery handling occurs between the stations 18 and 16. It will be appreciated however that there is no reason why hosiery could not be loaded at station 18. Further, although the transfer mechanism shown in FIG. 10 has a wheel with three limbs, it will be appreciated that any convenient number of limbs may be employed.

The sectional view of FIG. 11 shows the two wires 3 of the transfer form 1 spaced apart by a distance A with the hosiery boarding form 2 within the spacing and serving to strip hosiery from the transfer to the boarding form.

Although the invention has been described with respect to the transfer of hosiery between a toe-closing machine and a hosiery boarding machine it will be apparent that the invention is not limited in this respect since the transfer mechanism of the invention can be used for transferring articles, not necessarily knitted articles, between any two machines.

I claim:

1. A transfer mechanism for transferring hosiery between a first machine and a second machine wherein the hosiery has an open mouth, a foot end and an elastic welt portion, said transfer mechanism comprising a transfer form and a boarding form means for removing hosiery from the first machine and supporting the mouth of the hosiery upon said transfer form, means for extending the hosiery while the hosiery is supported upon the transfer form, means for driving the hosiery onto the transfer form, and means for introducing said boarding form to the foot end of the hosiery to draw the hosiery onto the boarding form while simultaneously turning the hosiery.

2. A transfer mechanism according to claim 1 wherein the means for extending the hosiery comprises a stream of air directed to extend the hosiery outwardly from the transfer form with the mouth of the hosiery secured upon the transfer form by the electric welt portion.

3. A transfer mechanism according to claim 2 wherein the first machine is a toe-closing machine and the second machine is a hosiery boarding machine.

4. A transfer mechanism according to claim 1 wherein the means for driving the hosiery onto the transfer form comprises a pair of rollers arranged in driving engagement with opposed parts of the hosiery adjacent the mouth of the hosiery.

5. A transfer mechanism according to claim 1 wherein the transfer form consists of two spaced apart members between which the boarding form passes to turn the hosiery.

6. A transfer mechanism according to claim 5 wherein each of said members consists of a wire bent into the general form of the Greek letter omega.

7. A transfer mechanism according to claim 1 wherein a plurality of transfer members are provided operatively connected to a wheel which is indexable between a plurality of stations at and between which operations are performed upon hosiery carried upon the transfer form.

8. A transfer mechanism according to claim 1 wherein the means for removing hosiery from the first machine comprises a clamp having jaws, the jaws being closeable onto the hosiery adjacent the hosiery foot end, and means for imparting movement to the clamp in an outward and downward direction to remove the hosiery from said first machine.

9. A transfer mechanism according to claim 8 wherein a photo-electric cell is provided beneath said clamp, with downward movement of the clamp continuing until the mouth of the hosiery is detected by the cell which is thereby actuated to cause cessation of said clamp downward movement.

10. A transfer mechanism according to claim 9 wherein suction pipes are provided adjacent the photo-electric cell, and means for operating said suction pipes upon actuation of the photo-electric cell to open the mouth of the hosiery.

11. A transfer mechanism according to claim 10 wherein a spreader having fingers is provided adjacent the open mouth of the hosiery, the fingers, when in a closed condition, are caused to enter said hosiery open mouth, the fingers then being caused to move to an open position so opening wider the mouth of the hosiery.

12. A transfer mechanism according to claim 11 wherein means are provided for moving the transfer between the open spreader fingers, further movement of the transfer form removing the hosiery from the fingers of the spreader, the jaws of the clamp then being arranged to open to release the hosiery, leaving the hosiery supported solely on the transfer form.

* * * * *